United States Patent [19]

Tuneski et al.

[11] 4,361,249

[45] Nov. 30, 1982

[54] BEVERAGE CONTAINER LID

[76] Inventors: Richard J. Tuneski, 1035 Franklin Rd., Apt. N-5, Marietta, Ga. 30060; Robert M. Frisbey, 1200 Marifran Dr., Conyers, Ga. 30207

[21] Appl. No.: 238,271

[22] Filed: Feb. 25, 1981

[51] Int. Cl.[3] ..... A47G 19/22

[52] U.S. Cl. ..... 220/254; 215/317; 220/90.4; 229/7 R

[58] Field of Search ..... 220/90.2, 90.4, 90.6, 220/254, 260, 262; 229/43, 7 R; 215/311, 317; 222/490

[56] References Cited

U.S. PATENT DOCUMENTS

| | | | |
|---|---|---|---|
| 2,003,657 | 6/1935 | Stubblefield | 215/317 |
| 2,393,322 | 1/1946 | Houghton | 222/490 |
| 2,646,670 | 7/1953 | Spalding et al. | 215/311 |
| 3,730,399 | 5/1973 | Dibrell et al. | 220/90.4 |
| 3,952,910 | 4/1976 | Wheeler | 220/90.4 |
| 4,081,103 | 3/1978 | Zoellick | 220/268 |
| 4,138,033 | 2/1979 | Payne et al. | 220/90.4 |
| 4,190,174 | 2/1980 | Haimowitz | 220/90.4 |
| 4,210,256 | 7/1980 | Amberg et al. | 220/90.4 |
| 4,245,752 | 1/1981 | Prueher | 220/90.4 |

*Primary Examiner*—William Price
*Assistant Examiner*—Gary E. Elkins
*Attorney, Agent, or Firm*—Newton, Hopkins & Ormsby

[57] ABSTRACT

An improved liquid container lid which includes a cover section which snap-fittingly engages the top rim of the container and which has an opening therethrough and a bottom section that is secured to the underside of the cover section and has a projection that extends through the opening. A passage is provided through the bottom section which is normally closed, but when the user presses downwardly upon the projection, liquid passes from the container through the opened passage and out of the opening.

5 Claims, 3 Drawing Figures

BEVERAGE CONTAINER LID

BACKGROUND OF THE INVENTION

1. Field of the Invention

This invention relates to liquid container attachments and, more particularly, to a non-spillable drinking container lid.

2. Description of the Prior Art

Economical and easy to use non-spilling drinking container covers have long been sought after. The function of these types of covers or lids is to prevent spillage of the contents of a liquid container while allowing the user to have selective access to the interior of the container.

The prior art container lids normally required a complicated valving system that was susceptible to leakage and which was very expensive. Still other such devices did not provide for resealing the closure in the lid once that closure was opened.

SUMMARY OF THE INVENTION

The above disadvantages are overcome by the present invention which discloses a lid for a beverage container comprising a top cover portion which is detachably connected along its outer periphery to the rim of the container and a bottom portion which is secured about one of its ends to the underside of the cover portion and which has a projection which extends through an opening in the cover portion.

The other end of the bottom portion terminates in a lip which extends beneath at least a portion of the outer periphery of the cover portion. A slit laterally extends through the bottom portion between the projection and the lip.

When the lid is placed on the container, the bottom portion is in sealing engagement with the underside of the cover portion. The upper lip of the user presses upon the projection, causing the bottom portion to move downwardly between the juncture of the bottom portion with the cover portion and the slit, thereby elongating the slit along a vertical axis and moving it to its open position. The contents of the container can then pass through the slit and out of the opening in the cover position into the mouth of the user. Release of pressure on the projection allows the bottom portion to move to its original sealing engagement with the cover portion, closing the slit.

BRIEF DESCRIPTION OF THE FIGURE OF THE DRAWING

DETAILED DESCRIPTION OF THE EMBODIMENT

Figure 1:
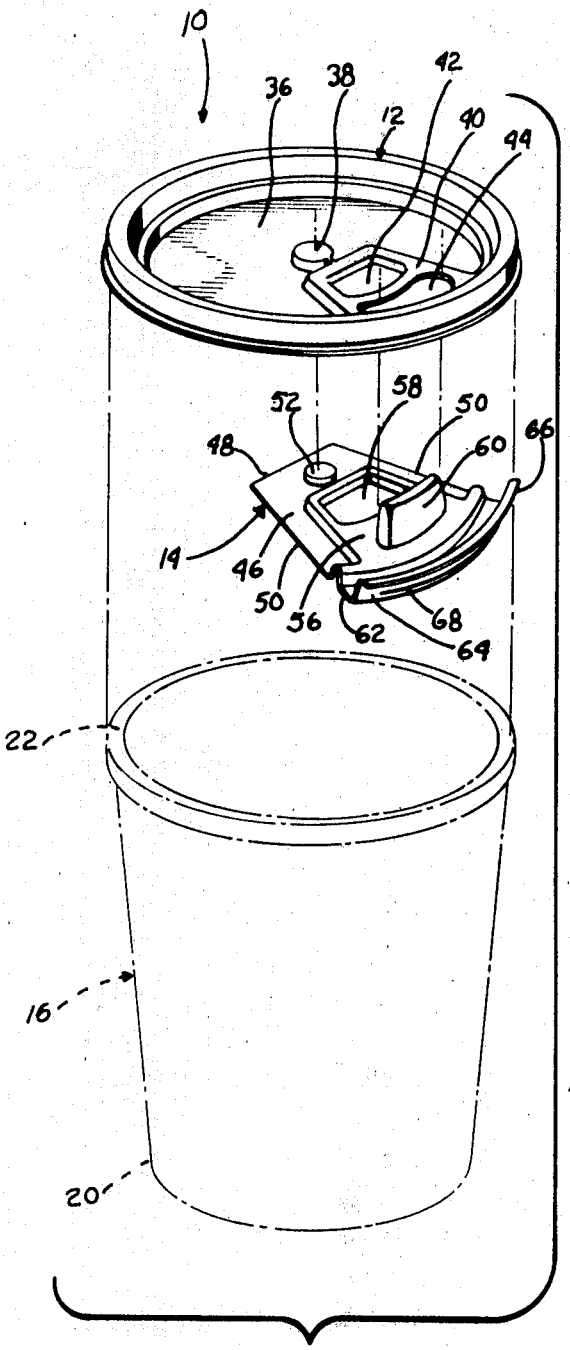
FIG. 1 is an exploded perspective view of the lid of the present invention with a liquid container shown in phantom lines.

The numeral 10 denotes generally the lid of the present invention and comprises a cover portion 12 and a bottom portion 14. The portions 12, 14 are formed of conventional thermoformed plastic material which is commonly used for disposable container lids. The lid 10 is designed to cover a container 16 after the container 16 is filled with a liquid. Container 16 can be constructed of any desired material and dimensions. The container 16 has a flat, circular bottom 18 and an upwardly and outwardly extending cylindrical side wall 20 which terminates in top annular rim portion 22.

The cover portion 12 is circular in shape and has a diameter that is sufficient to cover the container 16 about rim 22. The outer periphery of the cover portion 12 includes a downwardly directed, annular, U-shaped channel 24 having an upper edge 26 and opposed, resilient side walls 28 with the outer wall 28 terminating in an outwardly directed flange 30. The walls 28 are spaced apart sufficiently to receive rim portion 22 therebetween in snap-fitting engagement.

Arcuate section 32 joins the inner side wall 28 to circular rib 34 which is of a lower height than upper edge 26 and which surrounds central, flat section 36. Centrally disposed on section 36 is a raised, circular socket 38. Raised section 40 includes a depression 42 and an opening 44 therethrough.

The bottom portion 14 includes a flat portion 46 with a rear edge 48 and outwardly diverging sides 50. A ball 52 is formed on flat portion 46 which is in registry with socket 38 when the bottom portion 14 is secured to the underside 54 of the cover portion 12. Raised section 56 is complimentarily dimensioned to be received in nesting engagement within raised section 40 and includes depression 58 which receives depression 42. A projection 60 on bottom portion 14 extends through opening 44 and terminates above upper edge 26. The projection 60 has a contoured outer surface which engages the upper lip of the user.

Figure 2:
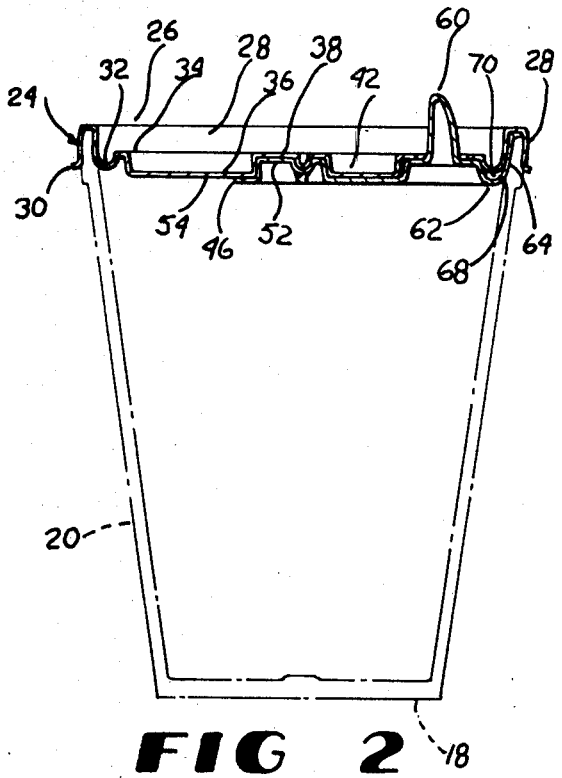
FIG. 2 is a side-elevation view in cross-section of the present invention on a container.
Figure 3:
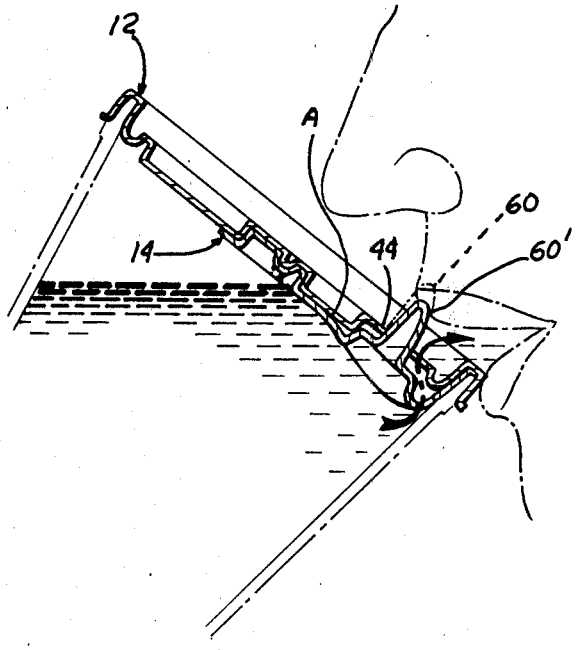
FIG. 3 is a view similar to FIG. 2 showing the invention in actual operation.

The end of bottom portion 14 opposite edge 48 includes a well 62 that has outer wall 64 which ends in lip 66 that engages rim 22 when the lid 10 is secured onto container 16. A slit 68 transversely extends through wall 64 adjacent well 62 and is movable between a closed position as seen in FIG. 2 and an open position as seen in FIG. 3. Although a slit is disclosed, it is understood that any shaped passage through wall 64 would be sufficient for the purposes of this invention.

As seen in FIG. 2, a space 70 is formed between well 62 and the underside 54 of arcuate section 32 when the lid 10 is in its assembled condition. The well 62 and wall 64 are formed of slightly thinner material than the remainder of lid 10 so that those areas will undergo elastic deformation as described below. The bottom portion 14 is secured to the underside 54 of cover portion 12 from edge 48 to approximately mid-way through depression 58 (as shown in FIG. 2 at point A) by conventional means, such as glue or heat-seal.

The assembled lid is detachably mounted onto rim 22 and assumes the configuration as shown in FIG. 2. In that manner, the top surface of lower portion 14 is in biased, upwardly sealing engagement with the underside 54 and the lid 10 provides a substantially leak-proof cover if the container 17 should be accidentally overturned. If the container 16 should be inverted, the liquid therein would bear against the undersurface of bottom portion 14, further pressing bottom portion 14 into sealing registration with cover portion 12.

When the user desires to drink from container 16, he raises it to his mouth whereby his upper lip engages projection 60. Continued upward movement of the container 16 causes the lip to press gently downward on projection 60 so that it moves to position 60' and a separation occurs between well 62 and wall 64 along slit 68. The bottom portion 14 pivots away from the cover portion about point A with wall 64 remaining stationary, due to lip 66. The slit 68 is thereby moved to its open position, so as to allow the liquid within container 16 to pass therethrough into space 70, out opening 44 and into the mouth of the user, as long as the upper lip is pressing downwardly on projection 60. The opening 44 is of sufficient dimension to allow air to enter the container 16 to aid in the removal of the liquid contents. An alternative method of utilizing lid 10 would be for the user to press downward on projection 60 with one of his fingers.

When the user is through drinking from the container 16, removal of the upper lip from the projection 60 allows the section of bottom portion 14 which had separated from cover portion 12, because of the resiliency of bottom portion 14, to spring upwardly to assume its position as shown in FIG. 2 with slit 68 moving to its normal, closed position. The user can repeatedly cause slit 68 to move to its respective open and closed positions until the liquid in the container 16 is consumed.

What is claimed is:

1. A lid for beverage container having a top rim portion, comprising:

(a) a cover section which is of a dimension to overlie said top rim section and having an outer periphery, an underside surface and an opening therethrough, said opening being defined by a leading edge, sides which intersect said leading edge and a rear edge;

(b) means on said outer periphery for releasably engaging said cover section to said top rim portion; and (c) a bottom section having an outer end that is in engagement with said engaging means and being secured to said underside surface adjacent said sides and rear edge, said bottom section normally underlying and being in sealing engagement with said opening along said leading edge, sides and rear edge and including a passage therethrough which is movable between a normally closed position and an open position in flow communication with the interior of said beverage container and said opening, said passage comprising a slit disposed toward said outer periphery of said lid adjacent said leading edge and conforming to the contour of said outer periphery, said bottom section being elastically depressible to move said passage to said open position when force is applied to said bottom section so that said slit is moved out of engagement with said cover section along said leading edge while said bottom section remains in contact with said underside surface adjacent said sides and rear edge and to cause said passage to return to said closed position when said force is removed therefrom.

2. A lid as claimed in claim 1 wherein said bottom section has means for engaging the lip of the user including a raised member on said bottom section which projects through said opening when said passage is in said closed position.

3. A lid as claimed in claim 1 wherein said engaging means includes a downwardly directed channel extending about said outer periphery and being of such a dimension to detachably receive therein said top rim portion.

4. A lid as claimed in claim 3 wherein said outer edge of said bottom section includes a lip which is complimentarily contoured to said channel so as to be received within said channel to grippingly engage said outer end to said cover section when said lid is on said container.

5. A lid as claimed in claim 2 wherein said lip engaging means is disposed on said bottom section between said outer end and said inner end and said passage is located between said lip engaging means and said outer end.

* * * * *